US006994410B2

(12) United States Patent
Hogan

(10) Patent No.: US 6,994,410 B2
(45) Date of Patent: Feb. 7, 2006

(54) POCKET DOOR SLIDE

(75) Inventor: Michael J. Hogan, Grand Rapids, MI (US)

(73) Assignee: Knape & Vogt Manufacturing Co., Grand Rapids, MI (US)

( * ) Notice: Subject to any disclaimer, the term of this patent is extended or adjusted under 35 U.S.C. 154(b) by 181 days.

(21) Appl. No.: 10/238,406

(22) Filed: Sep. 10, 2002

(65) Prior Publication Data

US 2004/0046488 A1 Mar. 11, 2004

(51) Int. Cl.
*A47B 88/00* (2006.01)

(52) U.S. Cl. ..... 312/322; 312/110

(58) Field of Classification Search ..... 312/331, 312/322, 323, 326, 327, 329, 110, 328, 245
See application file for complete search history.

(56) References Cited

U.S. PATENT DOCUMENTS

| | | | | |
|---|---|---|---|---|
| 2,936,206 A | | 5/1960 | Wilmer et al. | |
| 4,058,932 A | | 11/1977 | Peterson et al. | |
| 4,411,046 A | | 10/1983 | Nawrath | |
| 4,600,254 A | * | 7/1986 | Whalen | 312/323 |
| 4,641,896 A | | 2/1987 | Iimura et al. | |
| 4,729,612 A | | 3/1988 | Stone | |
| 4,817,241 A | | 4/1989 | Koch et al. | |
| 4,910,916 A | | 3/1990 | Dubach et al. | |
| 4,974,912 A | | 12/1990 | Rask et al. | |
| 4,976,502 A | | 12/1990 | Kelley et al. | |
| 5,078,461 A | | 1/1992 | Beck et al. | |
| 5,149,180 A | | 9/1992 | Haab et al. | |
| 5,323,569 A | | 6/1994 | Walz | |
| 5,395,165 A | | 3/1995 | Woerner | |
| 5,399,010 A | * | 3/1995 | McClung et al. | 312/334.1 |
| 6,282,770 B1 | * | 9/2001 | Lyon | 29/434 |

FOREIGN PATENT DOCUMENTS

| | | | |
|---|---|---|---|
| DE | 1143415 | * | 2/1963 |
| DE | 2306206 | * | 8/1974 |

OTHER PUBLICATIONS

Product specifications for Accurdie International's "AntiRak Cable System Flipper Door Slide", Dec. 2000.
Product specifications for Hafele's "Pocket Door Slide System", no date given.
Product specifications for Hafele's "XL–Slide Pocket Door Slide System", Apr. 1992.
Product specifications for Schock Metall's "Entertainment Center Design & Function", 7 pages no date given.

* cited by examiner

*Primary Examiner*—James O. Hansen
(74) *Attorney, Agent, or Firm*—Mayer, Brown, Rowe & Maw LLP

(57) ABSTRACT

A pocket door system for the suspension of a pocket door within an entertainment cabinet or the like is shown with a rack and pinion guide associated with each pocket door slide and a synchronization shaft for transmittal of the actuation of one pocket door slide to the other, and where the installation of the pocket door slide and rack and pinion guide are integral to each other and also provide an improved alignment methods.

30 Claims, 8 Drawing Sheets

POCKET DOOR SLIDE

BACKGROUND OF THE INVENTION

1. Field of the Invention

The present invention relates to a suspension system for supporting a cabinet door. More particularly, the present invention relates to a door slide system for the support of a door in a closed position, and allowing it to traverse to an open position, and thereafter, allowing it to be retracted into a position with at least a portion in a cabinet, in a state where it can be retrieved and restored to the fully open position and then ultimately to a closed position once again.

2. Description of the Related Art

In recent years, entertainment centers have become modified and, in particular, one type of entertainment center has evolved into a fairly common style of product. This particular type of entertainment center comprises an upright cabinet that may be camouflaged by style and finish to appear as though it were one of the existing pieces in a bedroom suite or other related articles of furniture in a residence or a hotel.

This cabinet is typified by having a pair of large doors that enclose an opening in the upper part of the cabinet area These doors may be opened and they would reveal a television set or a stereo system that has been conveniently hidden from view until and unless it is desired to be used. Many times, these cabinets air found in hotel rooms where they conveniently combine a series of drawers within the same cabinet, providing utilitarian storage as well as the provisions for the entertainment center.

Because it has been found to be desirable to keep the components of the entertainment center out of sight when not in use, the doors that are found on such cabinets provide an important function of concealment. As the design of this type of cabinetry evolved, it was not satisfactory to have the doors merely hinged onto the sides of the cabinet walls since they could rotate back into a semi-closed or fully closed position obscuring the entertainment center.

As a result, suspension systems for hanging the doors were developed that allowed the doors to traverse into the interior of the cabinet into a so-called "pocket" space in parallel alignment with the cabinet walls. The suspension systems have typically been based upon the usage of slide technology, notably precision slide technology, such as those found in office furniture applications and the like. In the case of the door applications, however, it is necessary to use a modified slide in a way that allows the door to be mounted to a portion of a sliding element, while at the same time allowing it to hinge when it reaches the fully opened position. In this manner, the functionality of the suspension system provides both an opening and closing relationship relative to the door and the hinge, as well as a transitioning action between a forward position and a rear position within the cabinet body.

These doors have now become known euphemistically as pocket doors and the slide suspension system that supports them in these applications has earned the moniker of pocket door slide.

A number of pocket door slide systems have been known in the prior art, including the Accuride 1332/1432 version (U.S. Pat. No. 4,974,912) which utilizes the components of the precision slides in the manner described above. However, it also utilizes a cable system to keep the door itself oriented correctly through all phases of the operation. The tendency of the door to sag or to deflect has been a problem in the industry, and the Accuride 1332/1432 is one attempt to solve this problem. The deflection or sagging of the pocket door in the installation has been exacerbated over time for the reason that the users of the entertainment systems have sought to install larger and larger componentry. This results in the need for a larger door, which brings along with it additional weight as well as height and width, all of which increases the loading on the pocket door slide tremendously. At present, the desire for increasing the load carrying capacity of the pocket door slide appears to continue to increase over time and the solutions that were brought forth previously by way of prior art are ill equipped to handle this ever increasing problem.

SUMMARY OF THE INVENTION

A pocket door slide system, comprising at least a pair of positioned door slides mountable onto the inner wall of a cabinet, further including a mounting means for mounting a pocket door thereto and oriented to provide translational movement from a rear position within the cabinet to a forward position outside of the cabinet and also to provide hinged rotation of the pocket door between an open position and a closed position with respect to the cabinet front.

The pocket door slide system of the present invention further includes a rack and pinion means which provides aligned orientation of the pocket door mounted to the pocket door system, while at the same time providing biased resistence to the loading experienced in pocket door assemblies.

The rack means for the present invention also includes specially perforated rack sections, allowing for convenient adjustment of the length of the rack to fit the commonly available sizes of the pocket door slide systems.

In addition, the pocket door slide system of the present invention also has an alignment feature, whereby the pinion gears associated with the mounting means and which guide the pocket door in the aligned position are provided a zero start point to ensure that both components of the pocket door system are positioned correctly.

It is an object of the present invention to provide a pocket door system that is easy to install.

It is also an object of the present invention to provide a pocket door system that is self-aligning in terms of the components.

It is an object of the present invention to provide a pocket door system that has a robust character that resists the increasing loading that is found in the pocket door applications of today.

These and other objects of the present invention will be explained in detail below.

DESCRIPTION OF THE PREFERRED EMBODIMENT

Figure 1:
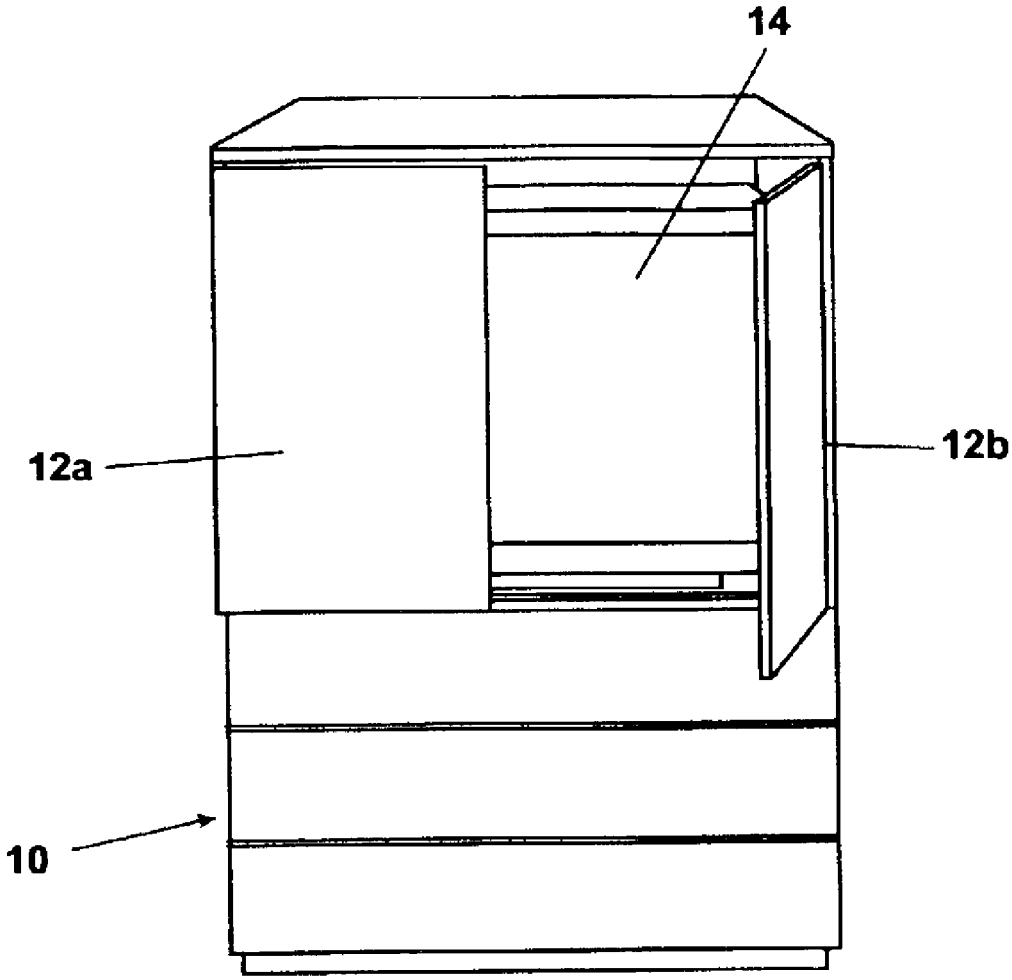
FIG. 1 is a front perspective view of an entertainment cabinet, housing a television set, and with one pocket door in the closed position and one pocket door in a semi-open position.

In accordance with FIG. 1, an entertainment cabinet 10 is shown with pocket doors 12*a* and 12*b* and is housing in this instance a television set 14. The entertainment cabinet is also shown with pocket door 12*a* in the closed position, and with pocket door 12*b* in a semi-open position, thus revealing the components inside the cabinet itself.

Figure 2A:
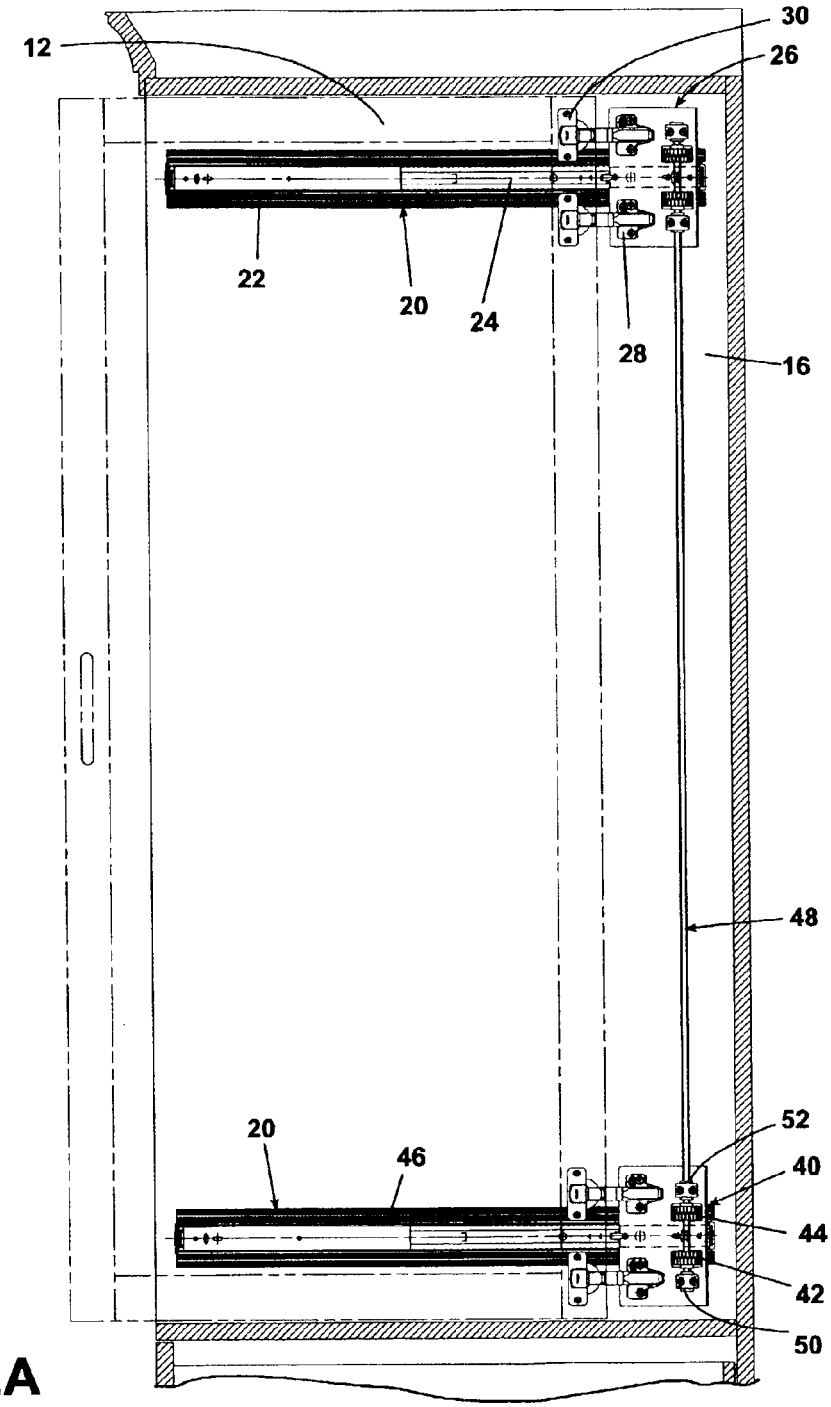
FIG. 2A is a cross-sectional view of the interior of an entertainment cabinet showing a pocket door as mounted to the pocket door system of the present invention and in the fully retracted position.
Figure 2B:
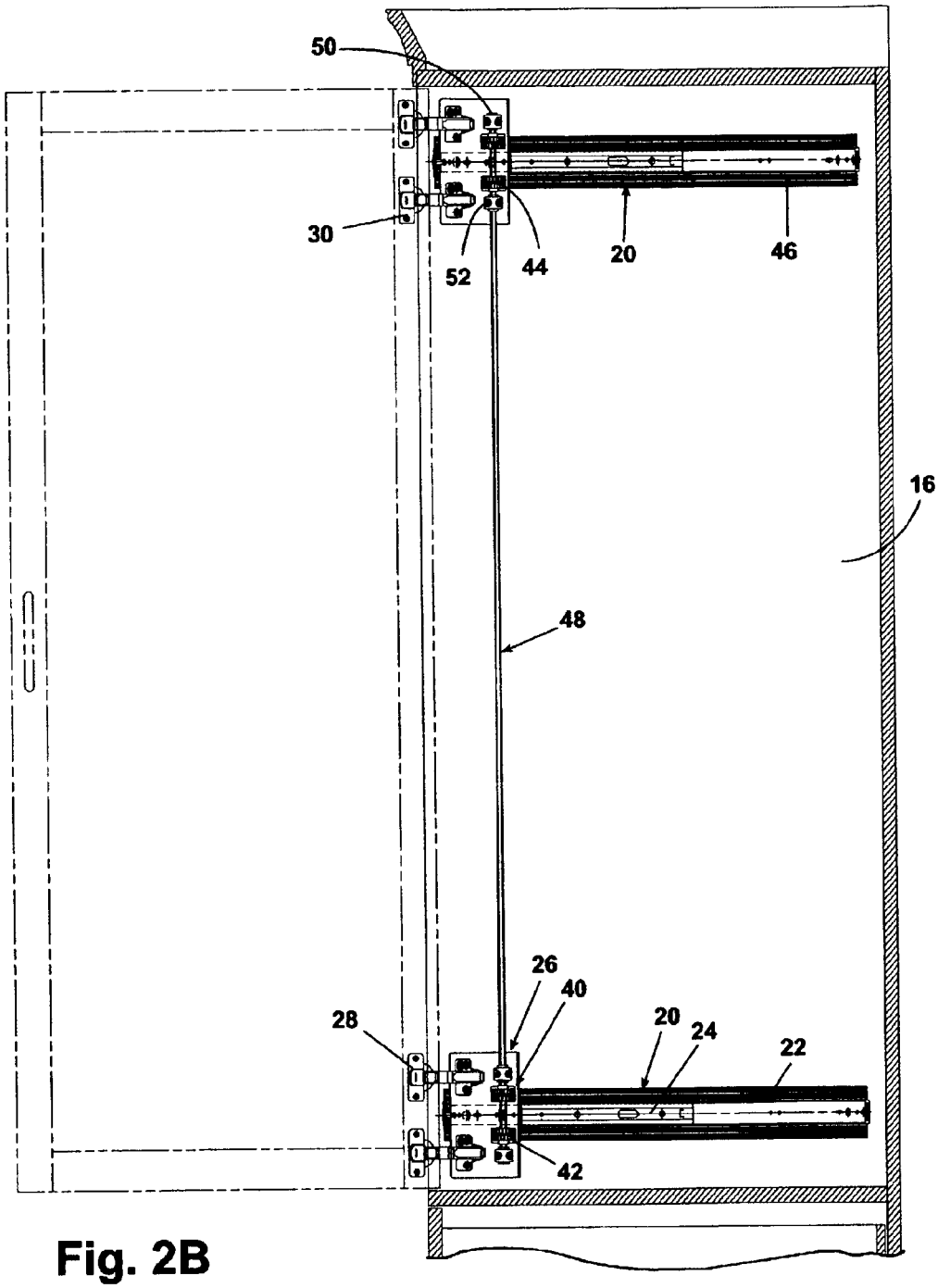
FIG. 2B is a cross-sectional view of a portion of an entertainment cabinet wherein the pocket door system is supporting a pocket door in the fully extended forward position.
Figure 2C:
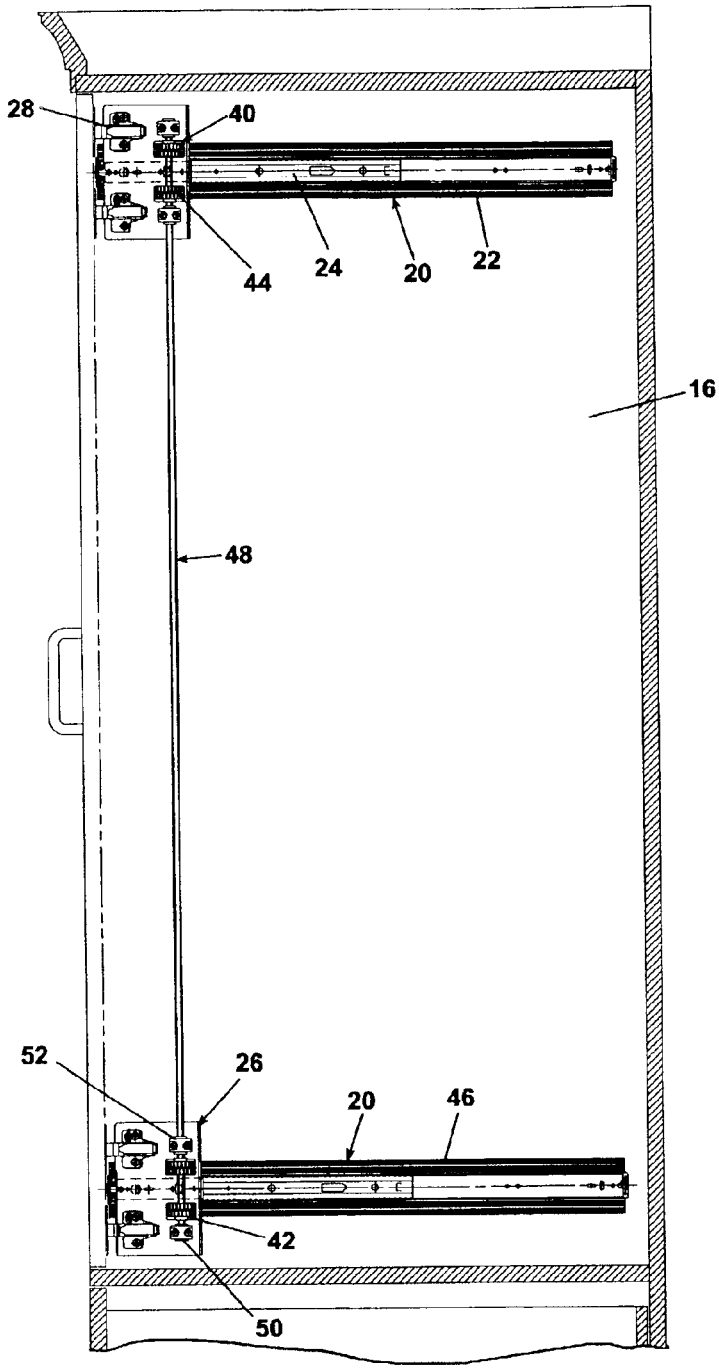
FIG. 2C is a cross-sectional view of a portion of an entertainment cabinet with a pocket door system supporting a pocket door in the fully extended position and in the closed position with respect to the cabinet front.

Turning now to FIGS. 2A–2C, the interior of the entertainment cabinet 10 is shown with pocket door 12 in phantom. Also revealed is cabinet wall 16.

In the application shown, pocket door slide 20 is shown as installed both at the top portion and the bottom portion of the cabinet wall. Each pocket door slide is further comprised of channel member 22, ball bearing retainer 24, mounting plate channel 54, and mounting plate 26. Located on the mounting plate 26 is hinge base 28 which is engaged with door hinge 30.

As may be viewed in the figures in gross detail, each pocket door slide 20 further includes at least one rack and pinion guide 40, which further comprises pinion gear 42 in close association with access hole 44 and in association with rack 46 having at least one row of teeth associated with pinion gear 42. Also included as part of the rack and pinion guide is the synchronization shaft 48, which includes shaft ends 50 and which is mounted to the mounting plate 26 by means of pillow block type shaft housings 52.

As indicated in the description of the drawings, the FIGS. 2A–2C represent a progression of events commencing with the pocket door in the fully retracted position, proceeding via translation to a fully extended position in FIG. 2B and ultimately via hinged rotation to a closed position, as shown in FIG. 2C.

Figure 3:
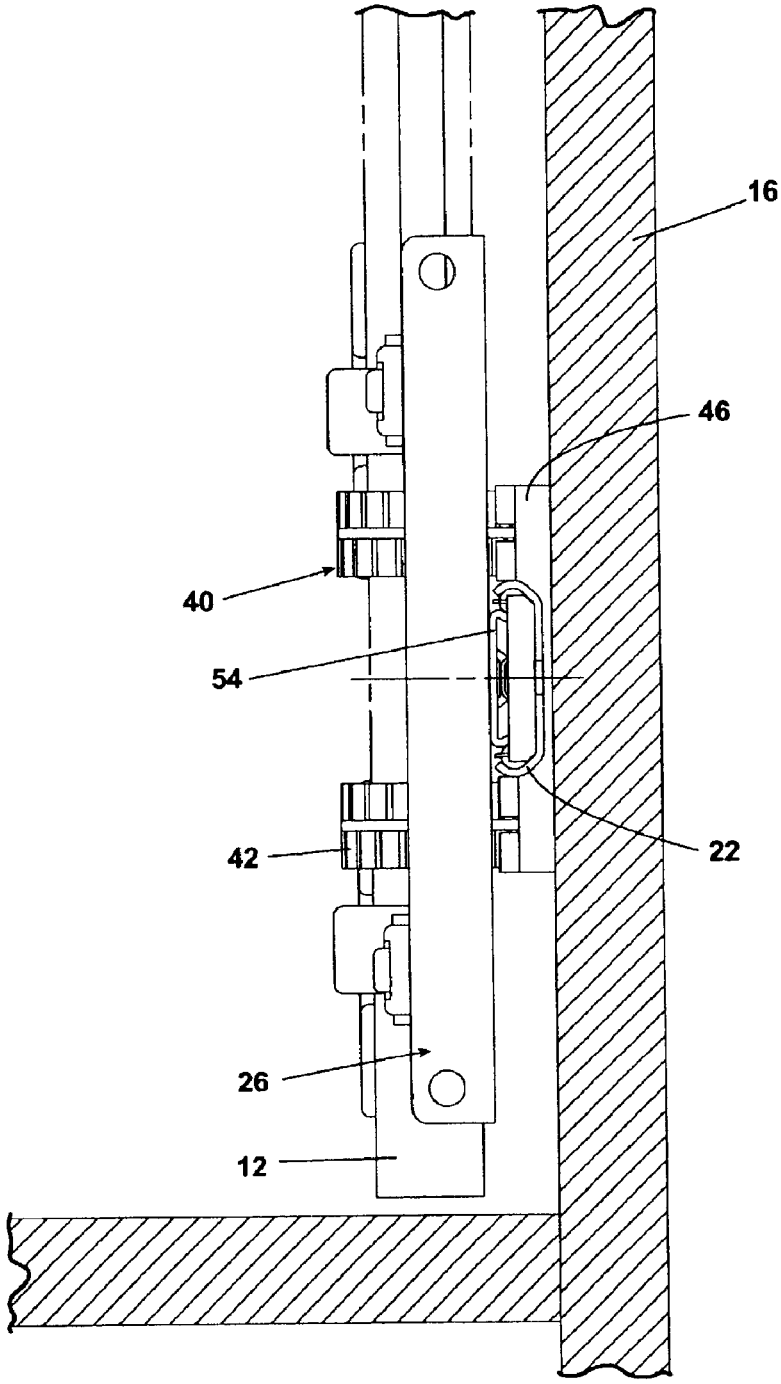
FIG. 3 is a cross-sectional view of a portion of an entertainment cabinet with a rear end view of a pocket door slide as installed onto a cabinet wall.

With reference to FIG. 3, components of the pocket door slide assembly can be viewed such as the mounting plate channel 54, which is in close cooperation with the ball retainer and accordingly slidably engages the channel member.

Figure 4:
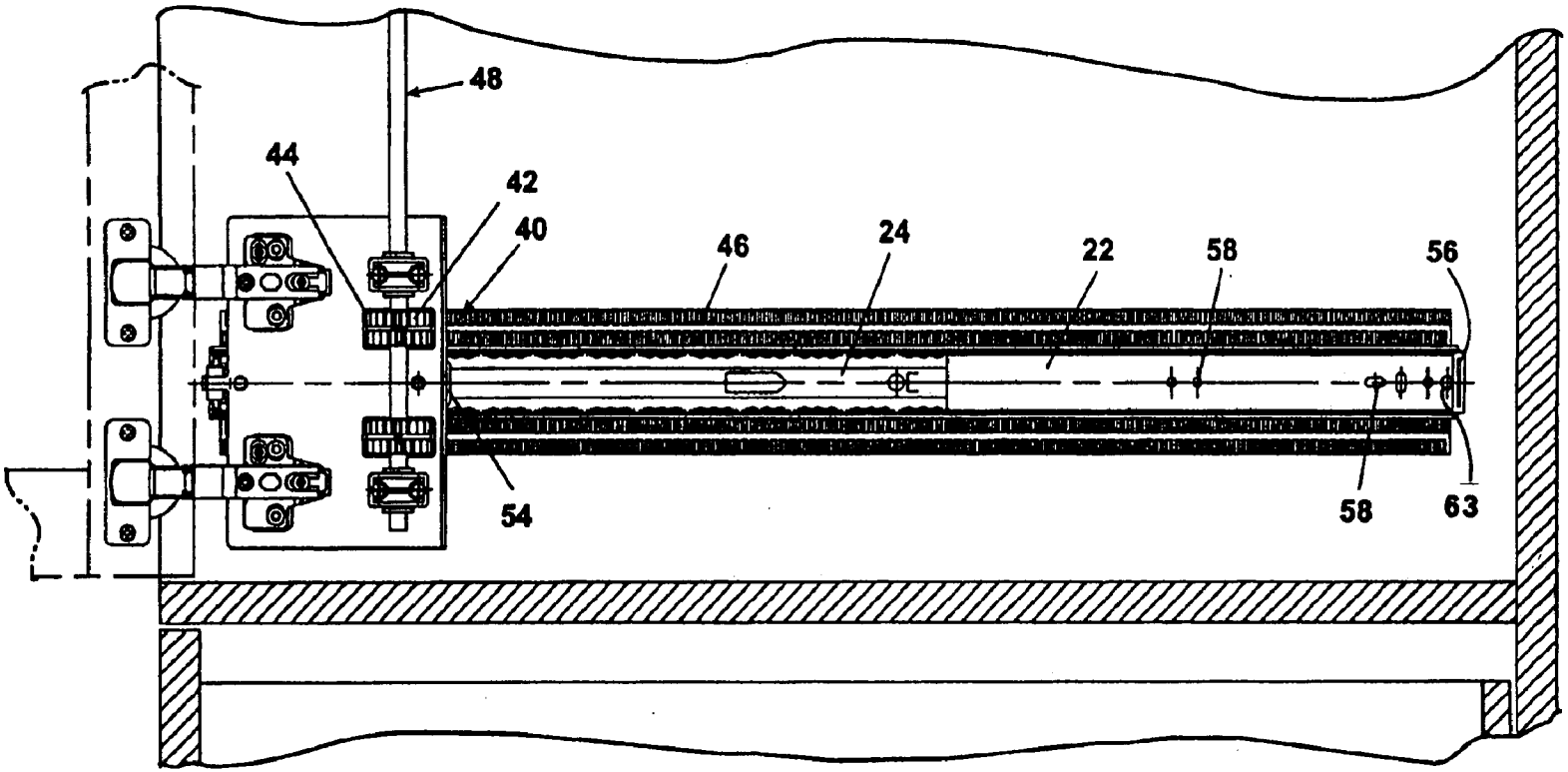
FIG. 4 is a cross-sectional view of a portion of an entertainment cabinet in similar orientation as that shown in FIG. 2B showing in detail one of the pocket door slides as installed.

FIG. 4 displays more detail with respect to the componentry of the present invention. FIG. 4 shows in detail one of the pocket door slides with the channel member 22, the ball bearing retainer 24, the mounting channel 54, the mounting plate 26, the rack and pinion guide 40, the pinion gears 42, the access holes 44, and the rack 46. Visible also is the rear stop 56, as well as the channel member mounting holes 58.

Figure 5:
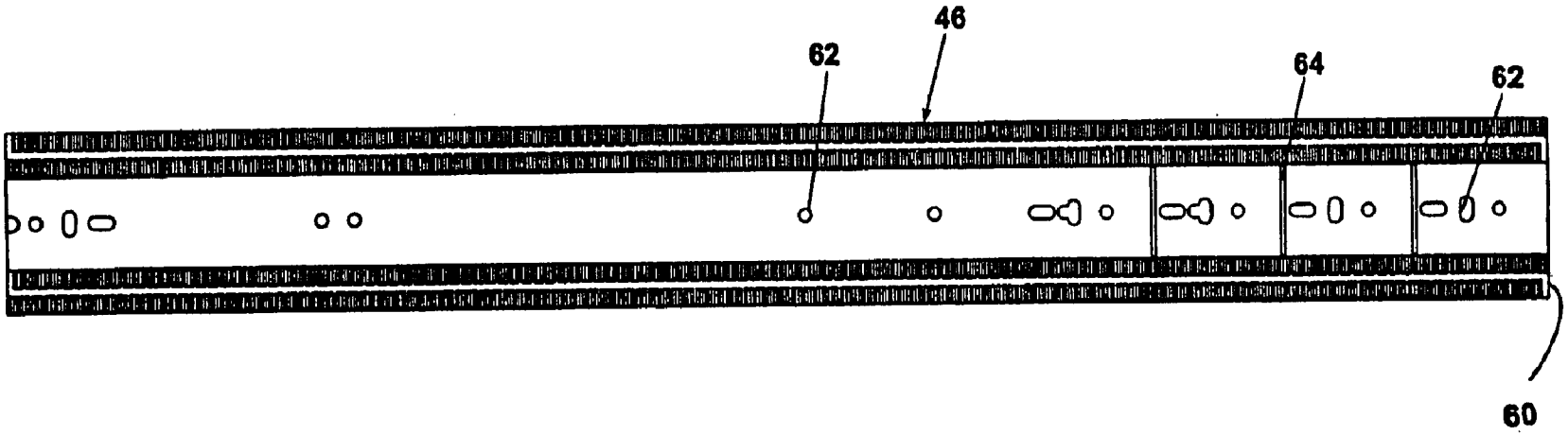
FIG. 5 is a side elevational view of a rack used in a pocket door slide such as shown in FIG. 3.
Figure 6:
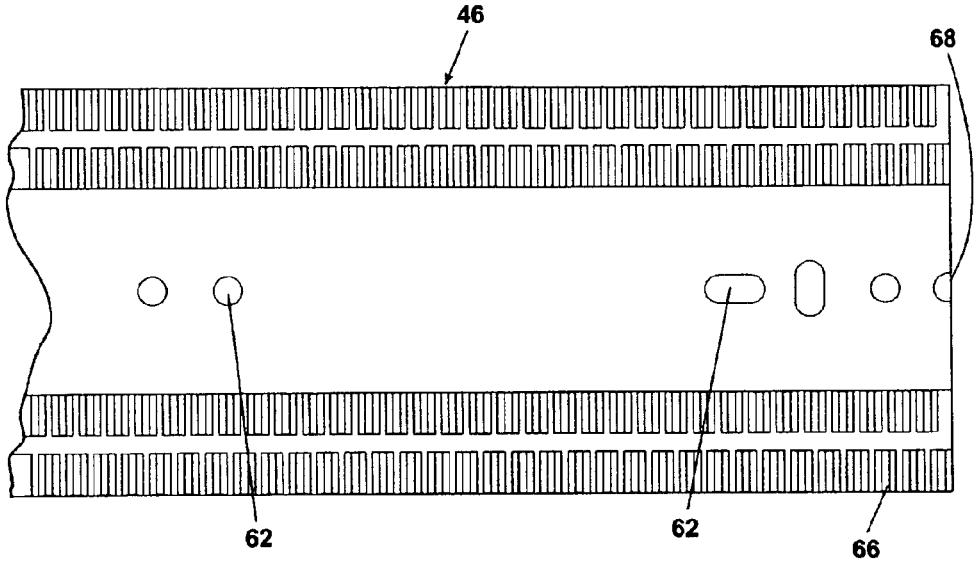
FIG. 6 is a side elevational view of the rear portion of the rack shown in FIG. 5.

Finally, turning to FIGS. 5 and 6, portions of the rack are shown in much more detail, notably with the rack front 60 and the associated mounting holes 62, and a number of slots or elongated perforations 64 to facilitate shortening of the rack 46 by breaking off one or more portions. FIG. 6 represents the opposite ends of the rack itself, with the rack rear 66 and with the alignment post 68.

In operation, a pocket door is made mountable to the mounting plate by using a conventional hinge assembly, commonly known as a "Euro-hinge." These hinges have numerous advantages, including their three-way adjustability and also the ability to remove the hinge door easily from the application.

The pocket door slide itself is made mountable to the side wall of a cabinet by means of screw fasteners. In order to do this, the channel member 22 is inserted into the interior of the rack, as can be seen in FIGS. 5 and 6, which has a recessed area that is able to receive the profile of the channel member 22. Simultaneously, the channel member has an alignment hole 63, best seen in FIG. 4, which is located at the rear of the channel member and which compatibly mounts onto the alignment post 68. By bringing together the channel member and the rack in this fashion, the two components are aligned perfectly relative to each other, and as will be noted once the forward portion of the channel member is located appropriately at the face frame or front vertical edge of the cabinet, then both the lower pocket door slide and an upper pocket door slide will be in alignment with each other.

The two pocket door slides are connected by the synchronization shaft 48. The shaft itself is retained by the shaft housings, located on the mounting plate 26. Actuation of the pocket door in a forward to rear or vice versa motion actuates the pinion as it travels along the rack. This action is transferred rotatably to the synchronization shaft, which communications the same actuation to the opposing pocket door slide. In this fashion, neither pocket door slide is allowed to move independent from the other, thereby fixing the pocket door slides in relationship to each other.

As now may be appreciated, in the concept of providing definitive alignment between the rack, the channel member reduces the alignment problems between one pocket door slide and the other to a simple question of alignment in the installation of each relative to the cabinet wall. In this regard, the face frame or front vertical case edge of the cabinet operates as a guide with respect to the installation of the pocket door slide, providing a common reference point from one pocket door slide to the other, resulting in a coherent and aligned installation in a very simplified manner.

Part of the benefits of associating the channel member within the recess of the rack is the fact that the alignment issue is solved, but it also simplifies the actual mounting of each to the cabinet wall. Since the channel member mounting holes are in parallel orientation with the mounting holes 62 in the rack, these may be brought together as one unit and screwed into the cabinet wall once the desired position relative to the face front has been established.

Another aspect to the present invention is the usage of the break offs 64 at the front portion of the rack. These break offs are set at predetermined lengths, consistent with the various sizes of pocket door slide assemblies, such that only one mold need be made to produce the rack and the resulting piece can be trimmed to fit the particular size product being installed. This has the advantage of reducing the cost of the plastic racks, while retaining all of the functionality as described above.

The usage of what amounts to a double rack and double pinion for each pocket door slide not only ensures that the actuation of the pocket door will be transmitted precisely and accurately between two or more of the pocket door slides, but it will also provide increased bias with respect to the tendency of the pocket door to load the system, and to sag. It is commonplace in the industry to install such systems with a slight cant or angle in the range of a few degrees in order to compensate for the deflection that is inherent in the components. However, beyond this, the double rack approach for each pocket door slide provides enough resistance to the continued loading so as to prevent any elastic deformation of the overall system, leading to a poorly aligned door.

It should be understood that the pocket door slides of the present invention could be ganged in multiples beyond the paired installation shown in the drawings. The synchronization shaft 48 can be allowed to extend above and below each pocket door slide, allowing multiple installations to occur, which can be beneficial when an extraordinary application is encountered. Special and custom installations where large doors or very large loads are to be handled can be sized appropriately and the advantages of the present invention allow that in such multiple installations alignment is ensured easily and accurately.

The embodiment disclosed within this application is meant to be illustrative of the present invention and is not meant to be limiting in any way with respect to its construction or its use in actual practice.

What is claimed is:

1. A pocket door slide assembly system for supporting a pocket door relative to a supporting wall of a cabinet, where the pocket door is movable between a retracted position substantially parallel to and alongside of the supporting wall and an extended position in which the door is further pivotally movable to be substantially perpendicular to the supporting wall, the system comprising at least two pocket door slide assemblies mountable to the supporting wall in spaced apart parallel relation to each other, each pocket door slide assembly further comprising:

a channel member attachable to the supporting wall, a mounting plate comprising a mounting channel that slidably engages the channel member, at least one hinge connected to the mounting plate and being oriented for attachment to the pocket door, a rack disposed between the channel member and the supporting wall and thereby being integrally mounted with the channel member when the channel member is attached to the supporting wall, a shaft housing connected to the mounting plate, and a gear engageable with the rack;

the system further comprising a shaft connected to each of the respective gears and shaft housings, thereby interconnecting the at least two pocket door slide assemblies.

2. A pocket door slide assembly system for supporting a pocket door as in claim 1, wherein each mounting plate further comprises an aperture through which the pinion gear extends to engage the rack.

3. A pocket door slide assembly system for supporting a pocket door as in claim 1, wherein each rack further comprises at least one row of teeth engageable by the pinion gear.

4. A pocket door slide assembly system for supporting a pocket door as in claim 1, wherein each rack further comprises at least two rows of teeth and each pinion gear further comprises at least two rows of teeth engageable with the respective rows of teeth on the respective rack.

5. A pocket door slide assembly system for supporting a pocket door as in claim 1, wherein each rack further comprises at least two series of apertures oriented perpendicular to the length of the rack to permit the rack to be shortened by breaking off a portion of the rack.

6. A pocket door slide assembly system for supporting a pocket door as in claim 1, wherein each rack further comprises an alignment portion that engages a respective compatible alignment portion on a respective channel member.

7. A pocket door slide assembly system for supporting a pocket door as in claim 6, wherein each rack alignment portion further comprises an upstanding post and each respective compatible alignment portion on a respective channel member further comprises an aperture.

8. A pocket door slide assembly system for supporting a pocket door as in claim 1, wherein each pocket door slide assembly further comprises at least two racks associated with and integrally mounted with each channel member when the channel member is attached to the supporting wall.

9. A pocket door slide assembly system for supporting a pocket door as in claim 8, wherein the at least two racks are joined by a web portion.

10. A pocket door slide assembly system for supporting a pocket door as in claim 8, wherein the at least two racks are formed as one piece.

11. A pocket door slide assembly system for supporting a pocket door as in claim 10, wherein the at least two racks are joined by a web portion.

12. A pocket door slide assembly system for supporting a pocket door as in claim 8, wherein each pocket door slide assembly further comprises at least two pinion gears mounted on the shaft, with each of the pinion gears engaging one of the respective racks.

13. A pocket door slide assembly system for supporting a pocket door as in claim 12, wherein each mounting plate further comprises at least two apertures corresponding to the at least two pinion gears through which the pinion gears extend to engage the rack.

14. A pocket door slide assembly system for supporting a pocket door as in claim 12, wherein each pocket door slide assembly further comprises at least two shaft housings connected to the mounting plate and rotatably engaging the shaft.

15. A pocket door slide assembly system for supporting a pocket door as in claim 1, wherein each pocket door slide assembly further comprises at least two hinges connected to the mounting plated and attachable to the pocket door.

16. A pocket door slide assembly system for supporting a pocket door relative to a supporting wall of a cabinet, where the pocket door is movable between a retracted position substantially parallel to and alongside of the supporting wall and an extended position in which the door is further pivotally movable to be substantially perpendicular to the supporting wall, the system comprising at least two pocket door slide assemblies mountable to the supporting wall in spaced apart parallel relation to each other, each pocket door slide assembly further comprising:

a channel member attachable to the supporting wall, a mounting plate comprising a mounting channel that slidably engages the channel member, a ball bearing retainer interconnected between the channel member and the mounting channel and further including a plurality of ball bearings that are disposed between the channel member and the mounting channel, at least one hinge connected to the mounting plate and being oriented for attachment to the pocket door, a rack disposed between the channel member and the supporting wall and thereby being integrally mounted with the channel member when the channel member is attached to the supporting wall, a shaft housing connected to the mounting plate, and a gear engageable with the rack;

the system further comprising a shaft connected to each of the respective gears and shaft housings, thereby interconnecting the at least two pocket door slide assemblies with the shaft in a position perpendicular to the pocket door slide assemblies.

17. A pocket door slide assembly system for supporting a pocket door as in claim 16, wherein each mounting plate further comprises an aperture through which the pinion gear extends to engage the rack.

18. A pocket door slide assembly system for supporting a pocket door as in claim 16, wherein each rack further comprises at least one row of teeth engageable by the pinion gear.

19. A pocket door slide assembly system for supporting a pocket door as in claim 16, wherein each rack further comprises at least two rows of teeth and each pinion gear further comprises at least two rows of teeth engageable with the respective rows of teeth on the respective rack.

20. A pocket door slide assembly system for supporting a pocket door as in claim 16 wherein each rack further comprises at least two series of apertures oriented perpendicular to the length of the rack to permit the rack to be shortened by breaking off a portion of the rack.

21. A pocket door slide assembly system for supporting a pocket door as in claim 16, wherein each rack further comprises an alignment portion that engages a respective compatible alignment portion on a respective channel member.

22. A pocket door slide assembly system for supporting a pocket door as in claim 21, wherein each rack alignment portion further comprises an upstanding post and each respective compatible alignment portion on a respective channel member further comprises an aperture.

23. A pocket door slide assembly system for supporting a pocket door as in claim 16, wherein each pocket door slide assembly further comprises at least two racks associated with and integrally mounted with each channel member when the channel member is attached to the supporting wall.

24. A pocket door slide assembly system for supporting a pocket door as in claim 23, wherein the at least two racks are joined by a web portion.

25. A pocket door slide assembly system for supporting a pocket door as in claim 23, wherein the at least two racks are formed as one piece.

26. A pocket door slide assembly system for supporting a pocket door as in claim 25, wherein the at least two racks are joined by a web portion.

27. A pocket door slide assembly system for supporting a pocket door as in claim 23, wherein each pocket door slide assembly further comprises at least two pinion gears mounted on the shaft, with each of the pinion gears engaging one of the respective racks.

28. A pocket door slide assembly system for supporting a pocket door as in claim 27, wherein each mounting plate further comprises at least two apertures corresponding to the at least two pinion gears through which the pinion gears extend to engage the rack.

29. A pocket door slide assembly system for supporting a pocket door as in claim 27, wherein each pocket door slide assembly further comprises at least two shaft housings connected to the mounting plate and rotatably engaging the shaft.

30. A pocket door slide assembly system for supporting a pocket door as in claim 16, wherein each pocket door slide assembly further comprises at least two hinges connected to the mounting plated and attachable to the pocket door.

* * * * *